United States Patent [19]

Norkoski et al.

[11] Patent Number: 5,046,298

[45] Date of Patent: Sep. 10, 1991

[54] METHOD AND APPARATUS FOR WRAPPING A ROLL WITH STRETCH WRAP

[75] Inventors: Joseph Norkoski, Cosmopolis; Norman E. Dornblaser, Elma; William H. Mehaffey, Olympia; Frank H. Lamb, Aberdeen, all of Wash.

[73] Assignee: Haines and Emerson, Inc., Hoquiam, Wash.

[21] Appl. No.: 520,789

[22] Filed: May 8, 1990

[51] Int. Cl.[5] ..... B65B 11/58

[52] U.S. Cl. ..... 53/399; 53/441; 53/415; 53/449; 53/136.2; 53/556; 53/587; 53/389.3; 53/176

[58] Field of Search ..... 53/141, 176, 137, 211, 53/399, 449, 441, 556, 587, 415, 136.2, 389.3

[56] References Cited

U.S. PATENT DOCUMENTS

| | | | |
|---|---|---|---|
| 1,351,809 | 9/1920 | Sutherland . | |
| 1,612,262 | 12/1926 | Coggins et al. . | |
| 1,689,430 | 10/1928 | Gwinn | 53/449 X |
| 1,714,532 | 5/1929 | Walter | 53/587 X |
| 1,871,765 | 8/1932 | Williamson | 53/137 X |
| 2,368,213 | 1/1945 | Gerlach . | |
| 2,803,935 | 8/1957 | Gibson | 53/137 X |
| 2,893,189 | 7/1959 | Lancaster | 53/587 |
| 3,710,539 | 1/1973 | Cothran | 53/449 |
| 3,750,361 | 8/1973 | Stevens | 53/141 X |
| 3,867,806 | 2/1975 | Lancaster, III et al. | 53/449 |
| 3,875,723 | 4/1975 | Sundin . | |
| 4,077,179 | 3/1978 | Lancaster | 53/441 |
| 4,137,690 | 2/1979 | Morgan | 53/176 |
| 4,201,028 | 5/1980 | Melehan | 53/137 |
| 4,244,471 | 1/1981 | Plante | 53/399 X |
| 4,528,802 | 7/1985 | Salzmann | 53/557 |
| 4,534,151 | 8/1985 | Schneck et al. | 53/415 |
| 4,565,049 | 1/1986 | DeLigt et al. | 53/415 |
| 4,744,198 | 5/1988 | Hood et al. | 53/415 |
| 4,782,645 | 11/1988 | Tajima et al. | 53/409 |
| 4,884,385 | 12/1989 | Mushinski | 53/399 |

OTHER PUBLICATIONS

Photocopies of Photographs of stretch-wrap dispenser sold by Lamb-Grays Harbor Co., before May 8, 1989.

*Primary Examiner*—John Sipos

*Attorney, Agent, or Firm*—Seed and Berry

[57] ABSTRACT

The invention involves a method of wrapping a roll wherein a sleeve wrap having a width substantially equal to the width of the paper roll is wraped around the cylindrical portion of the roll. A head of the same size as the end of the roll is coupled to each end of the roll. A stretch wrap is then wrapped around the ends of the roll so that approximately one-half of the stretch wrap covers a portion of the end of the roll and the other one-half lies in the same plane as the head. An end band may also be wrapped over the stretch wrap at each end of the roll. The invention also involves an apparatus that includes a trim slitter for trimming the sleeve wrap to the same size as the width of the roll.

23 Claims, 6 Drawing Sheets

METHOD AND APPARATUS FOR WRAPPING A ROLL WITH STRETCH WRAP

DESCRIPTION

1. Technical Field

This invention relates to a method and apparatus for wrapping objects for protection during shipping and handling, and more particularly, to an apparatus and method for wrapping rolls of paper with stretch wrap.

2. Background of the Invention

The need for wrapping objects such as paper rolls for protection during shipping and handling has long been recognized. The rolls can sustain damage from the equipment handling the rolls, from moisture that may come in contact with the roll, from other rolls when the rolls are stacked on end on top of each other, and from other external effects of the environment. The main problem in wrapping rolls, in particular, is the difficulty in obtaining a seal at the point where the cylindrical portion of the rolls meet the edges of the circular ends.

Various attempts have been made in wrapping rolls to create an effective seal at the edges where the cylindrical body and the circular ends meet. One method of creating such a seal is to wrap the roll with an oversized body wrapper and then crimp the part of the wrapper that extends beyond the cylindrical body, as shown in U.S. Pat. No. 2,368,213. In general, crimping involves doubling the wrapper extension onto itself and then folding the doubled wrapper extension down to lie in the same plane as the end of the roll.

There are several problems associated with crimping the wrapper extension in roll wrapping methods. First, crimping requires additional, specialized crimping equipment, which is expensive and obstructs equipment which might otherwise be used simultaneously with the roll wrapping equipment to apply, for example, an end cap or head. In addition, crimping does not adequately seal the end of the roll since the wrapper extension material is folded over onto itself. The doubled extension provides a channel through which moisture or other foreign substances can enter. The doubled corners also have a tendency to tear, which also may enable moisture to contact and damage the roll.

Another problem associated with crimping is that when rolls are stacked on end on top of one another, which is common in the roll manufacturing industry, the weight of the rolls and the extra material created by the doubled wrapper extension frequently damages the edges of the paper wrapped on the roll.

As shown in U.S. Pat No. 4,534,151, attempts have been made to cut off the excess material from the cylindrical body wrap after the roll has been wrapped. This type of system requires, however, complex, specialized equipment to cut off the excess wrapper material. This type of equipment also requires access to the ends of the roll to cut off the excess wrapper material.

Attempts have also been made to seal the edges where the cylindrical roll wrapper meets the edges of the circular heads. For example, U.S. Pat. No. 4,534,151 teaches the use of adhesive tape to seal the edge of a roll where the wrapper extension meets the heads. Use of adhesive tape to seal the roll is expensive, however, and also requires crimping of the portion of tape extending beyond the cylindrical body of the roll. In addition, the tape must be applied with precision because it becomes uneconomical to apply any amount of adhesive tape beyond what is absolutely needed.

Summary of the Invention

It is a primary object of the invention to provide a method of wrapping a roll that requires no pleating, crimping, or folding of the sleeve wrap material extending beyond the edge of the cylindrical roll body to seal the edges where the ends of the cylindrical body meet the edges of the circular heads.

Another object of the invention is to provide a method of wrapping a roll that creates an effective moisture seal at the edge of the roll where the cylindrical body and the edges of the circular heads meet.

Still another object of the invention is to provide a method of wrapping a roll so that the wrapped roll can be stacked on end on other rolls without the risk of damaging the edges of the paper wrapped on the rolls.

A further object of the invention is to provide a method of and apparatus for wrapping rolls of a variety of widths and a variety of diameters.

Another object of the invention is to provide an apparatus for wrapping a roll capable of cutting an oversized sleeve wrapper to be the same size as the width of the roll.

Yet another object is to provide an apparatus for wrapping a roll that senses the width of the roll so that the sleeve wrapper can be cut to correspond substantially to the width of the roll before the sleeve wrapper is wrapped around the roll.

The foregoing objectives are achieved by a method of wrapping a paper roll wherein a sleeve wrap having a width substantially equal to the width of the paper roll is wrapped around the cylindrical portion of the roll. A circular head having a diameter substantially equal to the diameter of the roll is coupled to each end of the roll. A stretch wrap is then wrapped around the ends of the roll while being stretched so that approximately one-half of the stretch wrap covers a portion of the end of the cylinder and the other one-half lies in the same plane as the circular head without the need of any crimping or folding equipment. Additionally, an end band may be wrapped over the stretch wrap at each end of the roll.

Also provided in the present invention is an apparatus that includes a trim slitter for trimming the sleeve wrap to be the same size as the width of the roll. As sleeve wrapper stock is fed down through the wrapper dispenser feed device, the sleeve wrap is directed onto a table, which includes a vacuum belt for holding the sleeve wrapper tight against the table. As the sleeve wrapper travels down the table, a trim slitter blade located on each side of the table trims the wrap to the same size as the width of the roll before the sleeve wrap is wrapped around the roll. Sensing means used in connection with the trim slitter sense the ends of the roll so that the trim slitter blades are adjusted to correspond to the width of the roll.

DETAILED DESCRIPTION OF THE INVENTION

Figure 1:
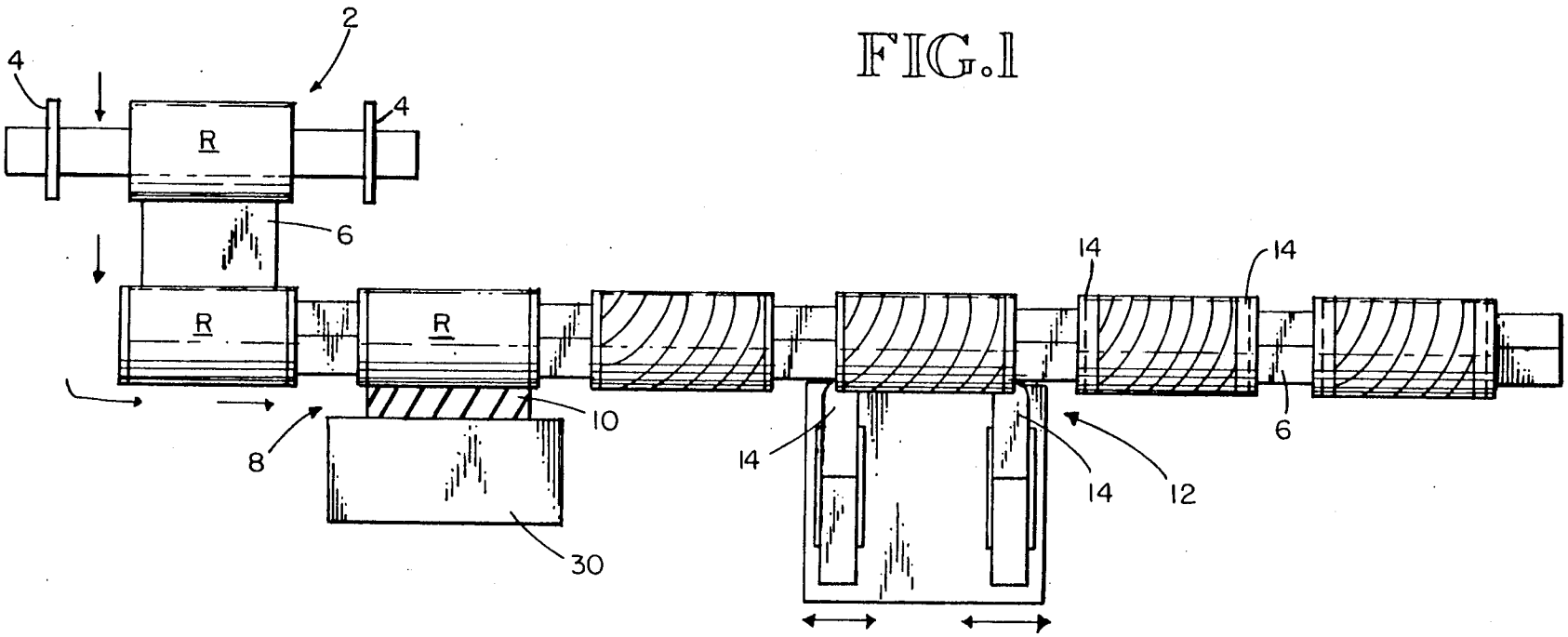
FIG. 1 is a schematic view of the method of wrapping a roll.

FIG. 1 shows by way of example one way to carry out the method of the present invention. A roll R is transferred to a head-applying station 2 where end caps or heads 4 are placed on each end of the roll. The roll then travels down a conveyor 6 to a sleeve wrapping station 8 where a sleeve wrap 10 of a width substantially equal to the width of the roll is wrapped around the cylindrical portion of the roll. A sleeve wrapper may be trimmed to the width of the roll at the sleeve wrapping station by using a trim slitter 30. The roll may then proceed down the conveyor to a stretch wrapping station 12 where stretch wrap 14 is wrapped around each end of the roll while being stretched so that approximately one-half of the stretch wrap covers the end of the cylindrical portion of the roll and the other one-half of the stretch wrap lies down in the same plane as the head and covers the outer edges of the head. While the schematic of FIG. 1 shows one sequence of steps in wrapping a roll, it is to be understood that the order of these steps could be interchanged. That is, the body wrap 10 could be applied before the heads, or the stretch wrap 14 could be applied to the roll as the first step in the wrapping method.

Figure 2:
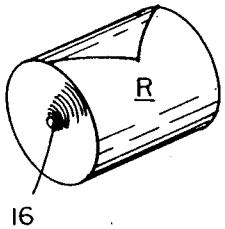

FIGS. 2–10 show the method of the present invention in a schematic representation. FIG. 2 shows a roll of paper, such as newspaper print used in the newspaper printing industry. The paper is rolled around a cylindrical core 16, which may be made of cardboard or some other similar material.

Figure 4:
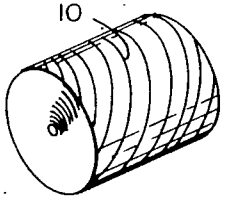
Figure 3:
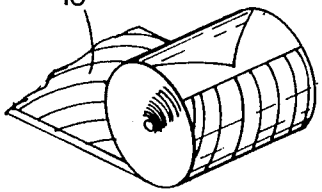

Referring now to FIG. 3, a sleeve wrap 10 is wrapped around the main cylindrical portion of the roll. The sleeve wrap is preferably made of a heavy paper or cardboard material. The method of applying the sleeve wrap can be by any method generally known in the art. One way of applying the sleeve wrap is as shown in U.S. Pat. No. 4,744,198, which is incorporated by reference in its entirety into the present application. The roll is wrapped with a sleeve wrap having a width which corresponds substantially to the width of the roll. Since the width of the roll is generally known, a stock of sleeve wrap can be selected to correspond to the width of the roll. Alternatively, the stock of sleeve wrap can be oversized and cut to the same size as the width of the roll before the sleeve wrap is wrapped around the roll. This method is especially suitable when rolls of various widths are being wrapped. The end result, therefore, is a roll wrapped with a sleeve wrap covering substantially the entire cylindrical outside surface of the roll without any sleeve wrap extension hanging over the ends of the roll, as shown in FIG. 4.

The width of the sleeve wrap 10 can be cut to the appropriate size by use of a trim slitter apparatus 30 as shown in FIGS. 11–14. The trim slitter cuts the ends of a sleeve wrap 10 as it is fed down from the sleeve wrap stock rolls 32 to a width which substantially corresponds to the width of the roll.

Figure 11:
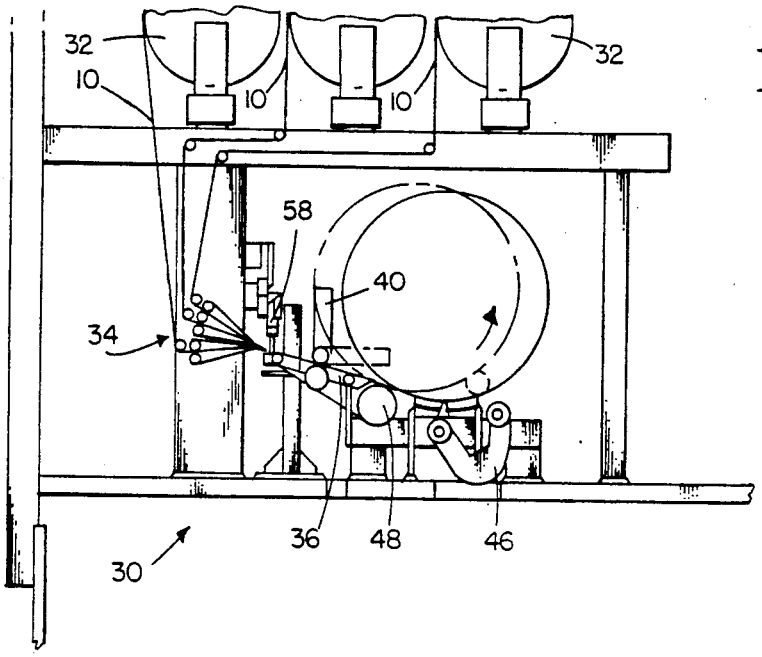
FIG. 11 is a side elevation view of the trim slitter of the present invention.

As shown in FIG. 11, sheets of sleeve wrap 10 of various widths supplied on sleeve wrapper stock rolls 32 are fed through a wrapper dispenser feed device 34. The appropriate width of sleeve wrap fed to the wrapping station 8 by the wrapper dispenser 34 can either be selected manually or automatically after the width of the roll is known. If the proper width of sleeve wrap is available on one of the sleeve wrap stock rolls 32, no cutting may be needed in order to wrap the roll.

Figure 13:
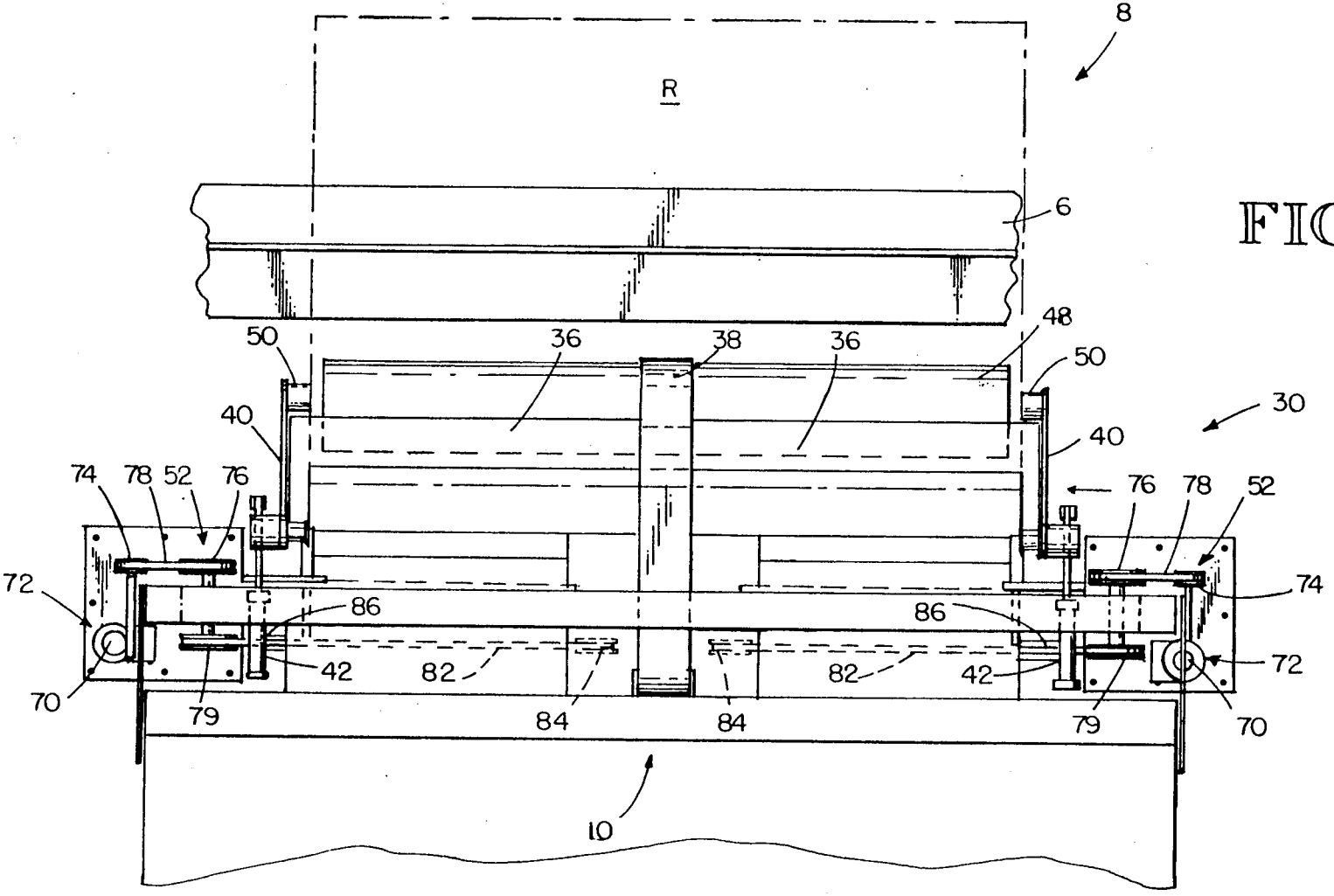
FIG. 13 is a top view of the trim slitter.

If, however, the sleeve wrap 10 must be cut to correspond to the width of the roll, an appropriate sleeve wrap from one of the sleeve wrap stock rolls 32 is selected at the wrapper dispenser feed device 34, ensuring that the sleeve wrap has a width greater than the width of the roll. The sleeve wrap is fed down onto a table 36 which includes a vacuum belt 38 located in the center of the table for holding the sleeve wrap in close contact with the table (FIG. 13). The vacuum belt is trained over a drive roller 48 and an electric motor 49 which helps the sleeve wrap to travel across the table.

Figure 12:
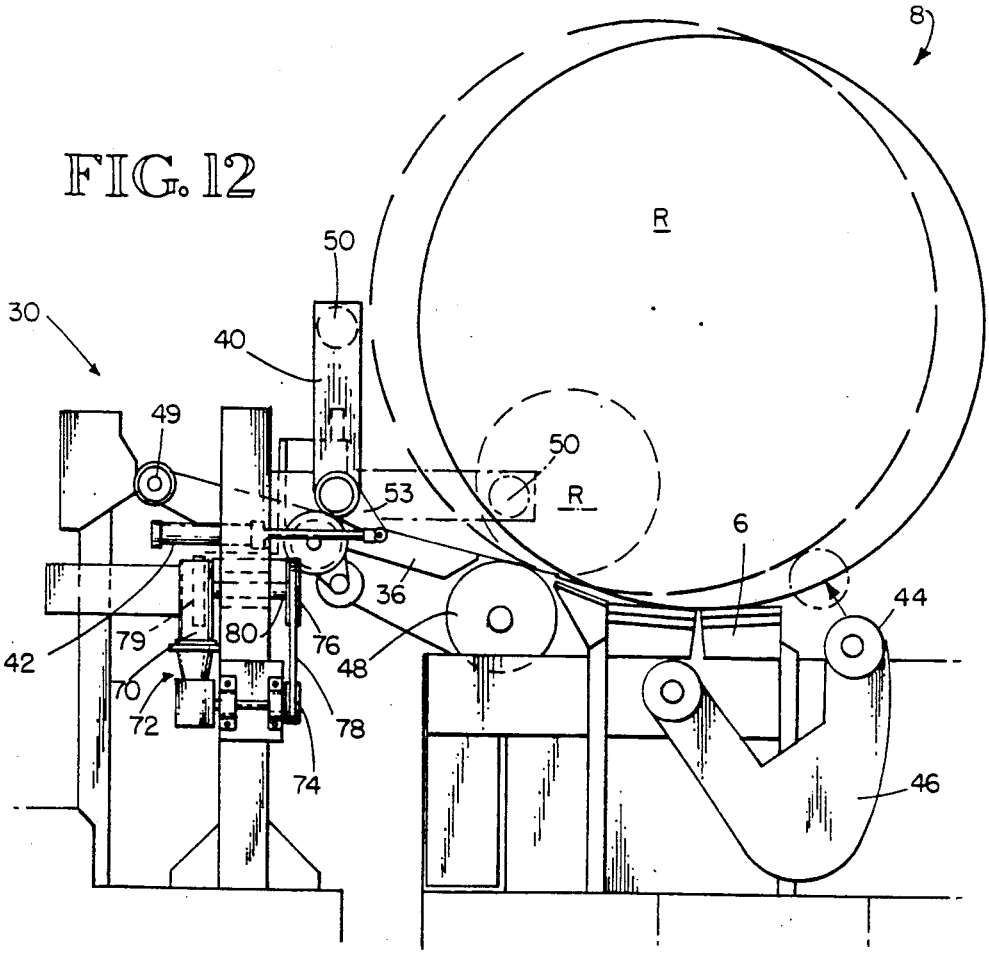
FIG. 12 is an enlarged, side elevation view of the trim slitter.

After the roll has arrived at the sleeve wrapping station 8 by way of conveyor 6, a lifter roller 44 attached to a lifter arm 46 engages the periphery of the roll to lift the roll off of conveyor 6 and onto to drive roller 48. The drive roller rotates the roll counter clockwise (as shown in FIG. 12) so that the sleeve wrap 10 can be wrapped around the roll. The lifter roller is capable of lifting various sizes of rolls (such as the small roll shown in phantom in FIG. 12) onto the drive roller so that they can be wrapped according to the present invention.

To determine the precise width of the roll, the trim slitter apparatus 30 includes an articulated arm 40 with a sensing means 50 coupled to the end of the articulated arm for sensing the end of the roll. The arm is articulated by an actuator 42 coupled to the articulated arm by means of a lever 43 which moves the arm from a vertical position (shown in solid lines in FIG. 12) to allow the roll to be moved via the conveyor 6 to the next station, to a horizontal position (shown in phantom) for engaging the end of the roll.

As shown in FIG. 13, each articulated arm 40 is attached to a slitter carriage 52 which moves the articulated arms laterally inwardly until they engage the ends of the roll. When the sensing means 50 sense the roll ends, the movement of the slitter carriages is stopped. It should be understood that the sensing means could be any type of mechanical or electrical sensing means.

As shown in FIGS. 12 and 13, a servomotor 70 powers a cone drive assembly 72, which in turn drives a drive pulley 74. The drive pulley is connected to a secondary pulley 76 via belt 78. The secondary pulley is coupled to a carriage pulley 79 by means of shaft 80. A carriage belt 82 is trained around the carriage pulley and in idler pulley 84 and is coupled to the carriage 52 at a clamping location 86 so that the carriage will translate toward and away from the roll by actuating the servomotor. The two slitter carriages operate independently of each other so that if the roll is off center, each carriage will independently move to engage the end of the roll.

Figure 14:
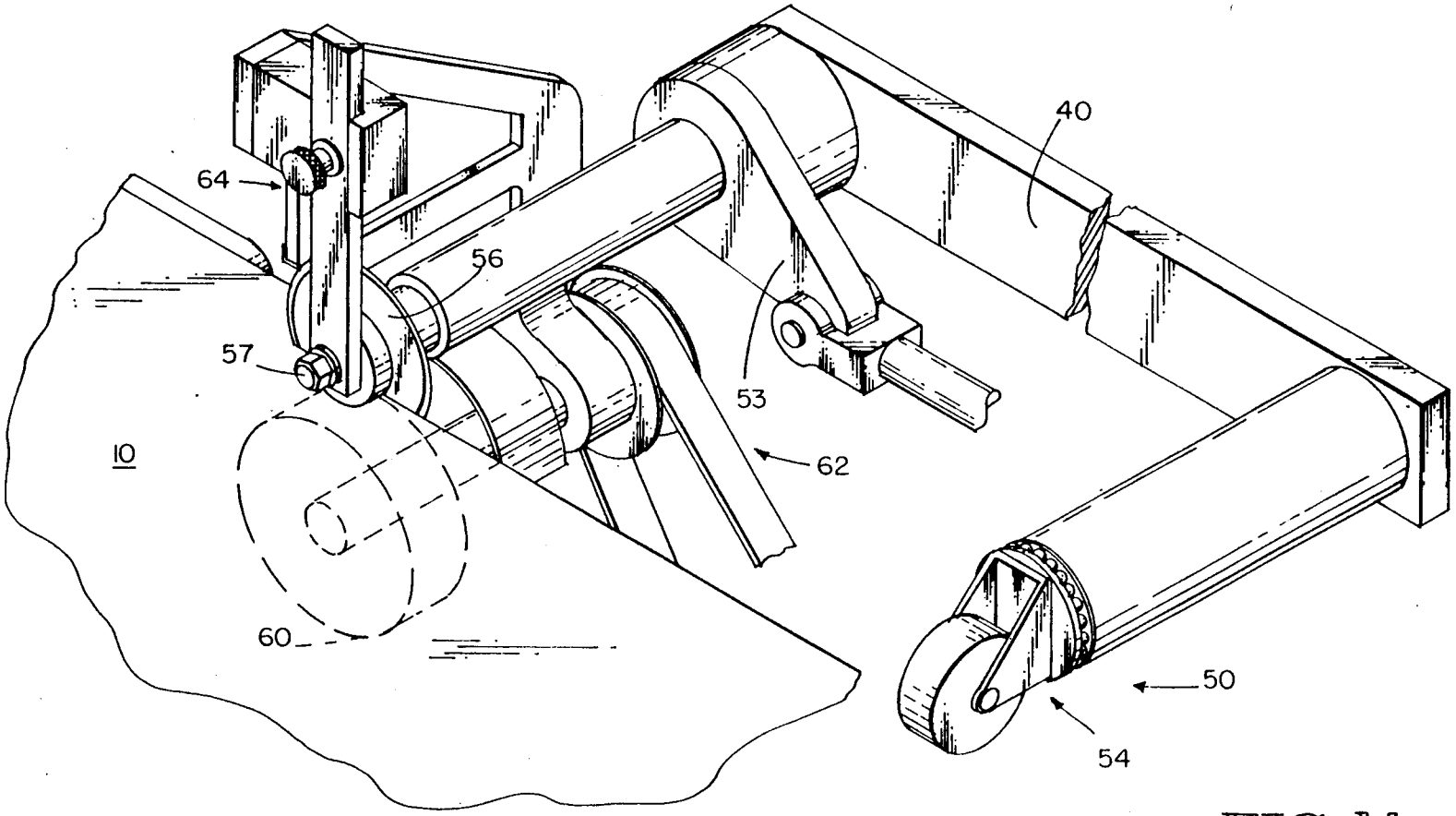
FIG. 14 is an enlarged perspective view of the trim slitter blade mechanism and sensing means.

Referring now to FIG. 14, one preferred sensing means 50 includes a caster 54 which is coupled to the articulated arm 40. The articulated arm and a trim slitter blade 56 are coupled to a common pivot axis 57. A corresponding anvil roller 60 and associated drive means 62 provide cutting support for the trim slitter blade. The end of caster 54 which contacts the end of the roll corresponds to the position of the trim slitter blade so that when the end of the roll is sensed by the caster, the trim slitter blade is in line with the end of the roll. An adjustment means 64 allows the height of the trim slitter blade to be adjusted.

It is preferable for the mechanical sensing means 50 to remain in contact with the ends of the roll yet allow the roll to rotate while the sleeve wrap 10 is being applied. This ensures that the trim slitter blade 56 remains in the proper position throughout the trim slitting process. Accordingly, it is preferable to use a caster 54 or other similar mechanical device which enables the roll to rotate while the caster remains in contact with the end of the roll.

After the desired amount of sleeve wrap 10 has been wrapped around the roll, an end cutter 58 (FIG. 11) cuts the sleeve wrap transversely to the desired length. The roll is then lowered by the bumper roller 44 onto the conveyor 6 so that the roll can continue to a subsequent station.

Figure 5:
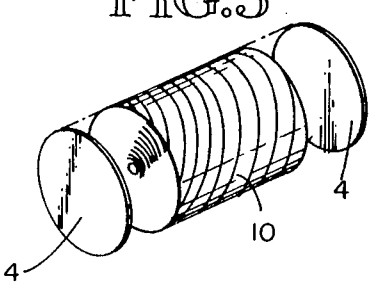
FIGS. 2–10 are perspective views included in an overall schematic of a roll being wrapped by the method of the present invention.
Figure 6:
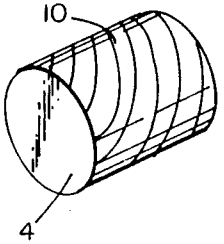

FIG. 5 shows the step of securing a head 4 onto each end of the roll. The head are preferably made of a thick paper or cardboard material and should correspond to the diameter of the roll. Alternatively, the diameter of the heads could be less than the diameter of the roll. As with the body wrap 10, the heads can be cut to the appropriate size before they are attached to the ends of the roll. Alternatively, a plurality of head sizes can be provided to a head applying apparatus to accommodate a variety of roll diameters. U.S. Pat. No. 4,744,198 shows a head applying apparatus which selects the appropriate diameter head from a head storage rack containing heads of various diameters. It should be noted, however, that any method generally known in the art for applying the heads so that the heads are centrally positioned on the ends of the roll may be used with the present invention. Commonly, a nail or staple is driven through the head and into the cylindrical core 16 to hold the head in place until the stretch wrap 14 is applied at a later station, as shown in FIG. 6.

Figure 7:
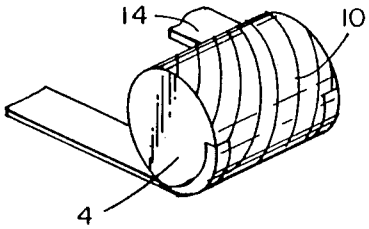
Figure 16:
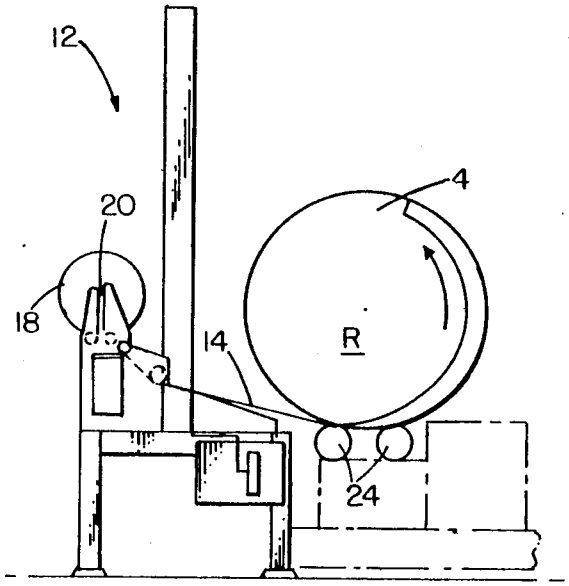
FIG. 16 is a side elevation view of the apparatus for applying the stretch wrap.
Figure 15:
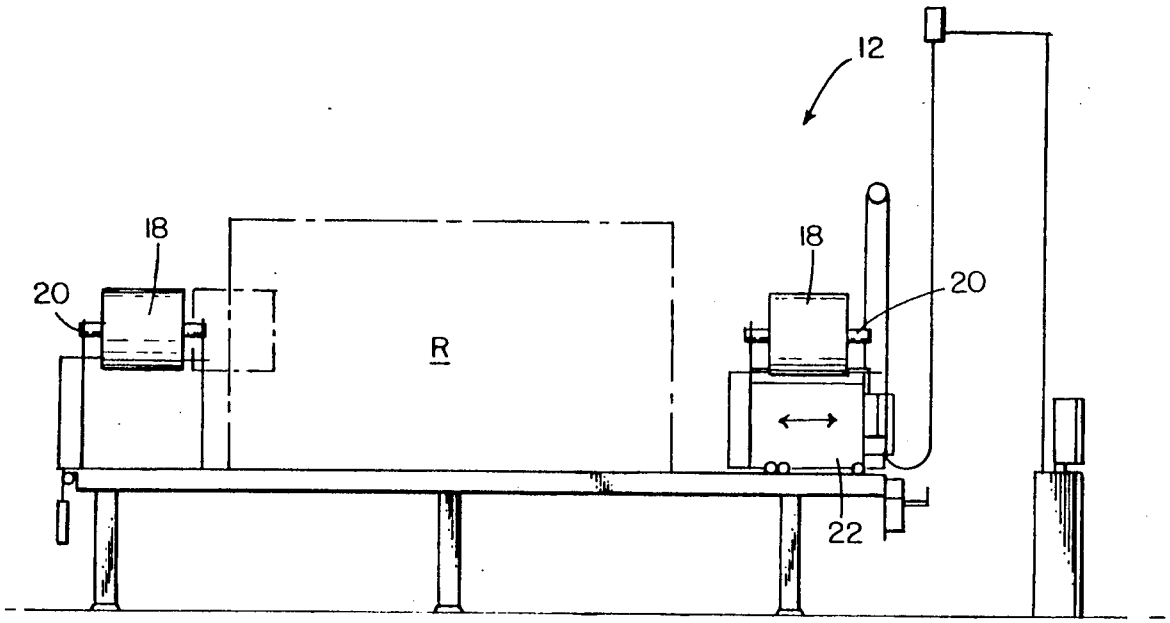
FIG. 15 is a front elevation view of the apparatus for applying the stretch wrap.

FIG. 7 shows a roll being wrapped with a stretch wrap 14. The stretch wrap comprises a plastic or polyvinyl material which itself may be stored on a stretch wrap supply roll 18 (FIG. 15). Referring to FIGS. 15 and 16, a roll of paper is positioned at a stretch wrapping station 12 for applying stretch wrap 14 to each end of the roll. A stretch wrap supply roll 18 is positioned on a spindle 20 coupled to a carriage 22 which positions the stretch wrap supply roll so that approximately one-half of the stretch wrap supply roll overlaps the end of the paper roll. Thus, a variety of roll widths can be wrapped with the present method and apparatus.

The stretch wrap 14 is started around the roll either by a small amount of adhesive or by charging the lead end of the stretch wrap with static electricity to electrostatically hold the stretch wrap onto the end of the roll. The paper roll is positioned on drive rollers 24 which rotate the roll in a counter-clockwise direction as shown in FIG. 16. Once the lead edge of the stretch wrap has been applied to the end of the roll, the gear ratio between the drive rollers 24 and the stretch wrap supply roll is adjusted so that the stretch wrap is stretched as it is applied to the roll. This causes the edge of the stretch wrap overhanging the end of the roll to lie flat against the circular head 4 without any folds or pleats. Accordingly, there is no need to use additional equipment to pleat or crimp the excess material extending over the roll, which would otherwise require additional, complex, expensive machinery.

Normally, the stretch wrap will stretch as much as 100% during the stretch wrapping process. It should also be noted that other methods known in the art for applying other kinds of wraps around a roll may also be used to apply the stretch wrap as contemplated by the present invention.

Figure 10:
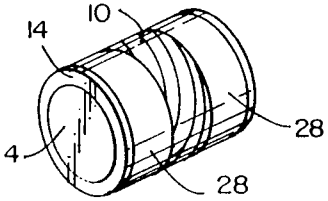
Figure 9:
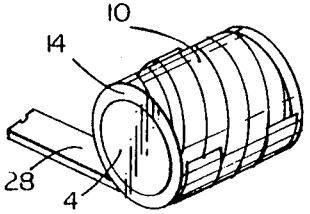
Figure 8:
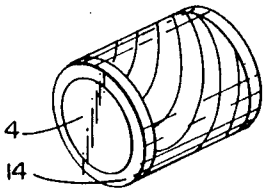

FIG. 8 shows a roll which has been wrapped with a body wrap 10, with attached heads 4, and with stretch wrap 14 applied on each end of the roll. If additional protection and additional securing of the stretch wrap is needed, an additional end band 28 can be applied to the cylindrical portion of the roll to overlap the stretch wrap 14 as shown in FIGS. 9 and 10. The end bands may be applied in a manner similar to the manner in which the stretch wrap was applied, except that the end bands would not overlap the ends of the cylindrical portion of the roll and no stretching would be involved.

While the preferred embodiments of the invention have been illustrated and described, it should be understood that variations will be apparent to one skilled in the art without departing from the principles herein. Accordingly, the invention is not to be limited to the specific embodiment illustrated in the drawings.

We claim:

1. A method for wrapping a roll, the steps comprising:

wrapping a roll having a width and two ends with a sleeve wrap, the sleeve wrap being of a width substantially equal to the width of the roll;

securing a head to each end of the roll, the size of the heads being substantially equal to the size of the ends of the roll; and wrapping each end of the roll with a stretchable stretch wrap material while simultaneously providing tension to the stretch wrap so that the stretch wrap stretches and covers both a portion of the width of the roll and a portion of the end of the roll to secure the heads and the sleeve wrap to the roll and create a seal at an edge of the roll where the roll width meets the roll ends without the need of additional equipment or a separate adhesive to hold the stretch wrap against the roll.

2. The method of claim 1, further comprising the step of:

securing an end band over a portion of the stretch wrap at each end of the roll to further secure the stretch wrap to the roll.

3. The method of claim 1, further comprising the step of cutting the sleeve wrap before the sleeve wrap is wrapped around the roll so that the width of the sleeve wrap is the same as the width of the roll.

4. The method of claim 3 wherein the step of securing the head comprises stapling the heads to the ends of the roll.

5. The method of claim 4 wherein the sleeve wrap, the heads, and the end bands are made of a paper material.

6. The method of claim 5 wherein the stretch wrap is made of a plastic material.

7. The method of claim 1 wherein the step of wrapping the roll with a stretch wrap material comprises:

attaching a lead edge of the stretch wrap material to the sleeve wrap of the roll so that a portion of the stretch wrap material extends beyond the end of the roll, the stretch wrap being supplied from a stretch wrap dispenser located adjacent the roll;

rotating the roll to remove the stretch wrap from the dispenser and wrap the stretch wrap around an edge of the roll;

applying tension to the stretch wrap while rotating the roll to force the portion of the stretch wrap hanging over the end of the roll to lie down in the same plane as the head without the need of additional crimping or flattening equipment, the stretch wrap creating a seal between the sleeve wrap and the head.

8. The method of claim 7 wherein the lead edge of the stretch wrap is electrostatically charged and secured to the sleeve wrap electrostatically to initiate the stretch wrapping step.

9. The method of claim 7 wherein the lead edge of the stretch wrap is secured to the sleeve wrap with an adhesive.

10. The method of claim 3 wherein the step of securing the sleeve wrap to the roll comprises attaching a lead edge of the sleeve wrap to the roll, rotating the roll at least 360 degrees, and attaching the trailing edge the sleeve wrap material to the roll.

11. An apparatus for applying a protective cover to a roll having a width and two ends, comprising:

means for determining the width of said roll;

means for trimming an oversized sleeve wrap to a width substantially equal to the determined width of said roll before wrapping the roll with the sleeve wrapper;

means for wrapping the trimmed sleeve wrap around the roll; and means for securing a head to each end of the roll, the diameter of the heads being substantially equal to the diameter of the roll.

12. The apparatus of claim 11 , further comprising:

means for wrapping the roll with a stretch wrap material to cover a portion of each end of the roll and a portion of the length adjacent each end to secure the sleeve wrap and heads to the roll and provide protection to the roll.

13. The apparatus of claim 12, further comprising:

means for applying an end band over top of the stretch wrap material to cover a portion of the stretch wrap material and provide additional protection for the roll.

14. The apparatus of claim 13 wherein the trimming means is capable of trimming the sleeve wrapper to correspond to a variety of roll widths.

15. The apparatus of claim 14 wherein the means for applying the heads are capable of applying a variety of head sizes to correspond to a variety of roll diameters.

16. An apparatus for applying a protective cover to a roll, comprising:

means for trimming an oversized sleeve wrap to correspond to a width of a roll having two ends before wrapping the roll with the sleeve wrapper;

means for securing the trimmed sleeve wrap to the roll;

means for securing a head to each end of the roll, the diameter of the heads being substantially equal to the diameter of the roll; and wherein the trimming means comprises:

a table for receiving a sleeve wrapper stock;

a pair of cutters, each cutter being located at opposite sides of the table to engage the sleeve wrap as it is fed down onto the table;

sensing means for sensing the ends of the roll to be wrapped so that the cutters are positioned in line with the width of the roll;

means for moving the cutters laterally inwardly or outwardly to correspond to the width of the roll;

means for feeding the wrapper stock through the cutters to trim the wrapper stock to correspond to the width of the roll.

17. An apparatus for applying a protective cover to a roll, comprising:

means for trimming an oversized sleeve wrap to correspond to a width of a roll having two ends before wrapping the roll with the sleeve wrapper;

means for securing the trimmed sleeve wrap to the roll;

means for securing a head to each end of the roll, the diameter of the heads being substantially equal to the diameter to the roll;

wherein the trimming means comprises:

a table for receiving a sleeve wrapper stock;

a pair of cutters, each cutter being located at opposite sides of the table to engage the sleeve wrap as it is fed down onto the table;

sensing means for sensing the ends of the roll to be wrapped so that the cutters are positioned in line with the width of the roll;

means for feeding the wrapper stock through the cutters to trim the wrapper stock to correspond to the width of the roll; and a vacuum belt trained over two opposite rollers and a center portion of the table for holding the sleeve wrapper stock against the table and advancing the sleeve wrapper along the table until the sleeve wrapper engages the roll.

18. An apparatus for applying a protective cover to a roll, comprising:

means for trimming an oversized sleeve wrap to correspond to a width of a roll having two ends before wrapping the roll with the sleeve wrapper;

means for securing the trimmed sleeve wrap to the roll;

means for securing a head to each end of the roll, the diameter of the heads being substantially equal to the diameter of the roll;

wherein the trimming means comprises:

a table for receiving a sleeve wrapper stock;

a pair of cutters, each cutter being located at opposite sides of the table to engage the sleeve wrap as it is fed down onto the table;

sensing means for sensing the ends of the roll to be wrapped so that the cutters are positioned in line with the width of the roll;

means for feeding the wrapper stock through the cutters to trim the wrapper stock to correspond to the width of the roll; and means for cutting a piece of sleeve wrap from a sleeve wrapper stock roll after an amount of sleeve wrap necessary to wrap the roll has been dispensed.

19. An apparatus for applying a protective cover to a roll, comprising:

means for trimming an oversized sleeve wrap to correspond to the width of a roll having two ends before wrapping the roll with the sleeve wrapper;

means for securing the trimmed sleeve wrap to the roll;

means for securing a head to each end of the roll, the diameter of the heads being substantially equal to the diameter of the roll;

wherein the trimming means comprises:

a table for receiving a sleeve wrapper stock;

a pair of cutters, each cutter being located at opposite sides of the table to engage the sleeve wrap as it is fed down onto the table;

sensing means for sensing the ends of the roll to be wrapped so that the cutters are positioned in line with the width of the roll;

means for feeding the wrapper stock through the cutters to trim the wrapper stock to correspond to the width of the roll; and wherein the sensing means comprises mechanical arm coupled to the cutter.

20. An apparatus for applying a protective cover to a roll, comprising:

means for trimming an oversized sleeve wrap to correspond to a width of a roll having two ends before wrapping the roll with the sleeve wrapper;

means for securing the trimmed sleeve wrap to the roll;

means for securing a head to each end of the roll, the diameter of the heads being substantially equal to the diameter of the roll;

wherein the trimming means comprises:

a table for receiving a sleeve wrapper stock;

a pair of cutters, each cutter being located at opposite sides of the table to engage the sleeve wrap as it is fed down onto the table;

sensing means for sensing the ends of the roll to be wrapped so that the cutters are positioned in line with the width of the roll;

means for feeding the wrapper stock through the cutters to trim the wrapper stock to correspond to the width of the roll; and wherein the sensing means comprises a photo electric eye.

21. An apparatus for applying a protective cover including stretch wrap to a roll, comprising:

means for trimming an oversized sleeve wrapper to correspond to a width of a roll having two ends before wrapping the roll with the sleeve wrapper, the trimming means comprising a table for receiving a sleeve wrapper stock, a pair of cutters, each cutter being located at opposite sides of the table to engage the sleeve wrapper stock as it is fed down onto the table, sensing means for sensing the ends of the roll to be wrapped so that the cutters can be positioned in line with the width of the roll, means for moving the cutters laterally inwardly or outwardly to correspond to the width of the roll, and means for feeding the wrapper stock through the cutters to trim the wrapper stock to correspond to the width of the roll;

means for securing the trimmed sleeve wrap to the roll;

means for securing a head to each end of the roll, the diameter of the heads being substantially equal to the diameter of the roll;

means for wrapping the roll with a stretch wrap material to cover a portion of the head at each end of the roll and a portion of the roll adjacent each end to secure the sleeve wrap and heads to the roll and provide protection to the roll; and means for applying an end band over top of the stretch wrap material to cover a portion of the stretch wrap material and provide additional protection for the roll.

22. An apparatus for wrapping a roll with stretch wrap, comprising:

means for wrapping a roll having a width and two ends with a sleeve wrap having a width corresponding to the width of the roll;

means for applying a head to each end of the roll, the diameter of each head being substantially the same as the diameter of the roll; and means for applying separate stretchable stretch wrap material at each edge of the roll where the sleeve wrap and the heads meet, said stretch wrap applying means comprises means for stretching the wrap as it is fed to the roll to stretch the wrap onto portions of the width of the roll and ends of the roll to secure the heads in place, the means for applying the stretch wrap material being located at each end of the roll.

23. The apparatus of claim 22, further comprising:

means for trimming the sleeve wrap to the same width as the roll before the sleeve wrap is wrapped around the roll.

* * * * *